US010627164B2

(12) United States Patent
Bignon et al.

(10) Patent No.: US 10,627,164 B2
(45) Date of Patent: Apr. 21, 2020

(54) VANE HANDLING FRAME

(71) Applicant: Safran Aircraft Engines, Paris (FR)

(72) Inventors: Yann Claude Daniel Bignon, Moissy-Cramayel (FR); Didier Christian Boisard, Moissy-Cramayel (FR); Philippe Germain Marie Joseph Jehanno, Moissy-Cramayel (FR)

(73) Assignee: Safran Aircraft Engines, Paris (FR)

( * ) Notice: Subject to any disclaimer, the term of this patent is extended or adjusted under 35 U.S.C. 154(b) by 248 days.

(21) Appl. No.: 15/755,148

(22) PCT Filed: Aug. 30, 2016

(86) PCT No.: PCT/FR2016/052151

§ 371 (c)(1),
(2) Date: Feb. 26, 2018

(87) PCT Pub. No.: WO2017/037380

PCT Pub. Date: Mar. 9, 2017

(65) Prior Publication Data

US 2018/0252474 A1 Sep. 6, 2018

(30) Foreign Application Priority Data

Aug. 31, 2015 (FR) ..... 15 58073

(51) Int. Cl.

| | |
|---|---|
| ***F27D 3/00*** | (2006.01) |
| ***F27D 3/12*** | (2006.01) |
| ***F27D 5/00*** | (2006.01) |

(52) U.S. Cl.
CPC ..... *F27D 3/0024* (2013.01); *F27D 3/12* (2013.01); *F27D 5/0018* (2013.01); *F27D 2005/0087* (2013.01)

(58) Field of Classification Search
CPC ..... F27D 3/0024
See application file for complete search history.

(56) References Cited

U.S. PATENT DOCUMENTS

| | | | | | |
|---|---|---|---|---|---|
| 2,179,073 | A | * | 11/1939 | Dames | C21D 9/0025 266/249 |
| 2,338,784 | A | * | 1/1944 | Ruckstahl | C21D 9/0025 432/261 |
| 2,461,606 | A | * | 2/1949 | Jackson | F27D 5/0006 432/261 |
| 2,710,746 | A | * | 6/1955 | Menough | C21D 9/0025 432/261 |

(Continued)

FOREIGN PATENT DOCUMENTS

| | | |
|---|---|---|
| DE | 10 2013 019 228 A1 | 7/2014 |
| WO | WO 2014/196574 A1 | 12/2014 |

*Primary Examiner* — Nathaniel Herzfeld
(74) *Attorney, Agent, or Firm* — Blank Rome LLP

(57) ABSTRACT

A framework for handling blades, comprising a bottom wall carrying a plurality of intermeshed longitudinal and transverse partitions forming a grid defining a plurality of housings each able to receive a blade. The framework comprises rods for supporting and holding the blades remote from the base wall and said longitudinal and transverse partitions, said rods crossing the longitudinal and transverse partitions and extending into the housings and being produced, at least externally, from a thermally insulating material.

7 Claims, 2 Drawing Sheets

(56) References Cited

U.S. PATENT DOCUMENTS

| | | | | | |
|---|---|---|---|---|---|
| 2,962,273 | A | * | 11/1960 | Moore | C23G 3/00 432/261 |
| 3,044,755 | A | * | 7/1962 | Bixby | C21D 9/0025 432/261 |
| 3,156,456 | A | * | 11/1964 | Menough | C21D 9/0025 432/261 |
| 4,290,753 | A | * | 9/1981 | Klefisch | C21D 9/0025 432/261 |
| 4,431,408 | A | | 2/1984 | Postich | |
| 4,818,833 | A | | 4/1989 | Formanack et al. | |
| 5,752,821 | A | * | 5/1998 | Jo | C21D 9/0025 269/54.5 |
| 6,558,159 | B2 | * | 5/2003 | Bollwahn | C21D 9/0025 220/4.31 |
| 6,939,131 | B2 | * | 9/2005 | Maumus | C21D 9/0025 248/346.01 |

* cited by examiner

VANE HANDLING FRAME

CROSS-REFERENCE TO RELATED APPLICATIONS

This application is a national stage of International Application No. PCT/FR2016/052151, filed on Aug. 30, 2016, which claims the benefit of French Patent Application No. 1558073, filed Aug. 31, 2015, the contents of each of which are incorporated herein by reference.

TECHNICAL FIELD

The present invention relates to a frame for handling vanes in addition to a method of use of said frame.

BACKGROUND

A vane handling frame comprising a plurality of individual housings for each vane is known. A frame of this kind serves to support the vanes with a view to their simultaneous movement in a heat treatment furnace.

The frame is generally made of metallic material and is covered with a thin layer of yttrided zirconia deposited by a plasma projection technique. Addition of this type of coating is necessary to avoid contact between a vane and the metallic material of the frame that might result in formation of a eutectic on the vanes, leading to a reduction in the metallurgical qualities of the vanes at the contact points.

It has been observed however that after having undergone several heat treatments, the yttrided zirconia becomes detached from the frame and may deposit itself on the vanes, resulting in their scrapping owing to a lack of mechanical conformity.

SUMMARY

The invention more particularly aims at providing a simple, efficient and cost-effective solution to the problems of the prior art disclosed above.

For this purpose, it provides a vane handling frame comprising a bottom wall bearing a plurality of longitudinal and transverse partitions forming a grid defining a plurality of housings, each capable of receiving a vane, characterised in that it comprises rods for supporting and holding the vanes away from the bottom wall and from said longitudinal and transverse partitions, wherein said rods cross the longitudinal and transverse partitions and extend into the housings and are produced, at least externally, from a thermally insulating material.

According to the invention, the vanes are supported by rods having at least one external surface produced from a thermally-insulating material, thereby avoiding contact between the vanes and the bottom wall as well as with the longitudinal and transverse partitions. Using this frame, the yttrided zirconia coating can be eliminated, avoiding deposits of this material on the vanes and subsequent pollution of the vanes. The conformity rate of the vanes is thus markedly increased.

Preferentially, the thermally-insulating material is a ceramic material, such as alumina 5×25.

Advantageously, the rods extend substantially parallel to the longitudinal or transverse partitions.

According to another characteristic of the invention, each housing is crossed by three groups of rods, each formed of at least two rods substantially parallel to each other, wherein the rods of a first group are arranged so as to support and hold the vanes away from the bottom wall, wherein the rods of a second group are arranged so as to hold the vanes away from the longitudinal partitions and wherein the rods of a third group are arranged so as to hold the vanes away from the transverse partitions.

The rods of the first group serve to support the vanes along a vertical axis, whereas the rods of the second and third groups provide lateral restraint of the vanes in both directions of space perpendicular to each other and to the aforementioned vertical direction.

According to yet another characteristic of the invention, each rod is formed of a rigid metal wire around which tubes made of ceramic material are engaged.

Use of a wire with tubes made of insulating material ensures good mechanical strength and good deformability of this assembly in a furnace for heat treatment of the vanes.

In a practical embodiment of the invention, the bottom wall comprises orifices and is in contact with a first grid formed of first longitudinal and transverse partitions which is connected by arms perpendicular to the bottom wall to a second grid formed of second longitudinal and transverse partitions.

The invention furthermore relates to a method for heat treatment of a vane, involving:

a) provision of a frame of the type previously described, b) insertion of the vanes into at least some of the housings in the frame such that the vanes come into contact with the supporting and holding rods, c) insertion of the frame bearing the vanes into a furnace for heat treatment of the vanes.

BRIEF DESCRIPTION OF THE DRAWINGS

The invention will be better understood, and other details, characteristics and advantages of the invention will appear upon reading the following description given by way of a non-restrictive example while referring to the appended drawings wherein.

DETAILED DESCRIPTION

Figure 1:
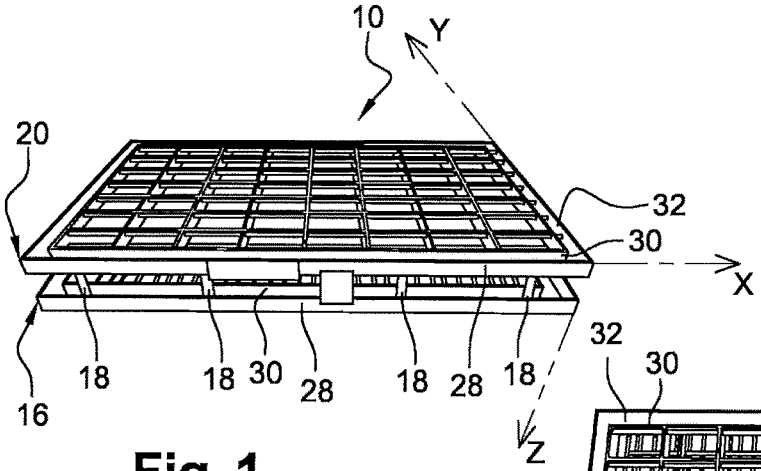
FIG. 1 is a schematic side view in perspective of a frame according to the invention.

Reference is first made to FIG. 1 which shows a frame 10 or vane handling platform according to the invention. In the rest of the description, the vertical direction is represented by the axis Z and the other two directions of space are represented by the axes X and Y perpendicular to each other and of the axis Z (the axis Y is shown along the right edge of the frame 10 in FIG. 1). The frame illustrated in the figures displays a rectangular shape in an XY plane. The frame 10 comprises a bottom wall 12 featuring air circulation orifices 14 and which is in direct contact with a first grid 16 formed of a plurality of first longitudinal partitions 16*a*

Figure 2:
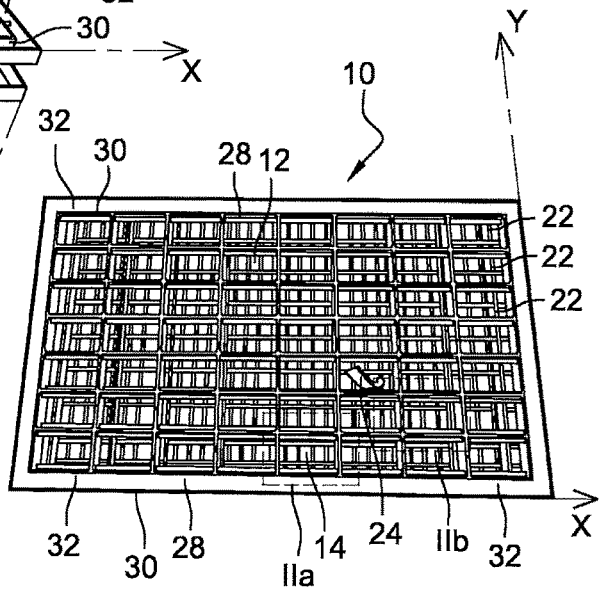
FIG. 2 is a schematic view in perspective of the top of the frame in FIG. 3.
Figure 3:
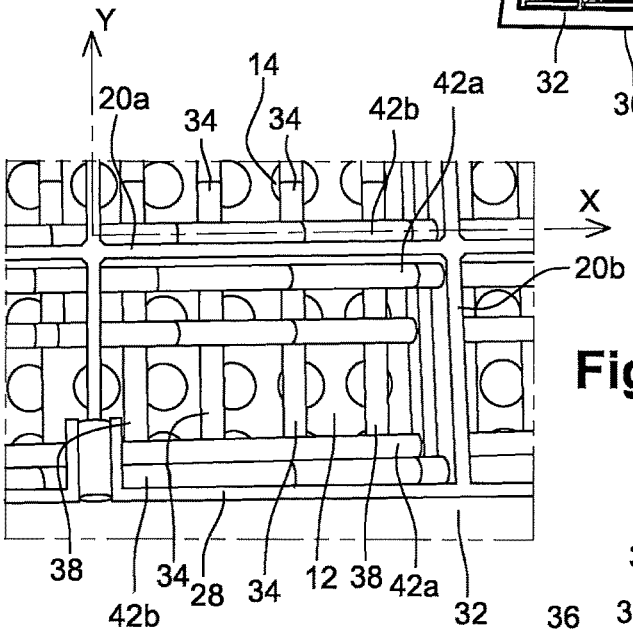
FIG. 3 is a larger scale view of the area Ma enclosed in dotted lines in FIG. 4.
Figure 4:
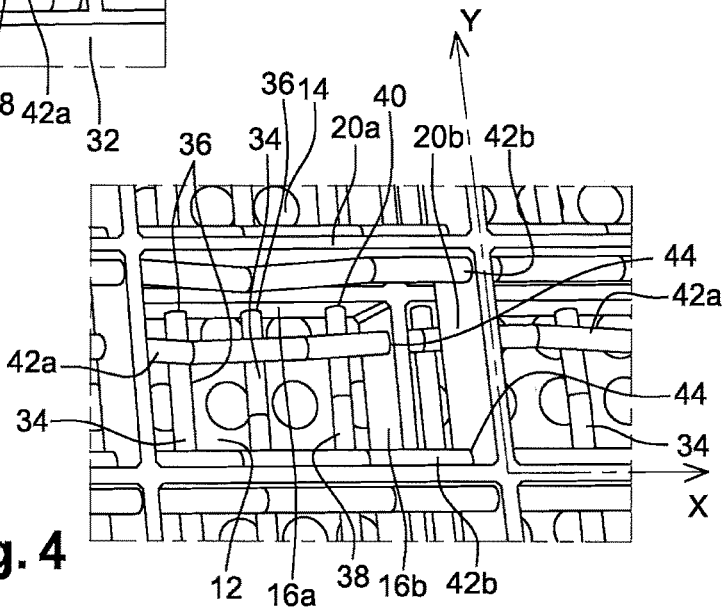
FIG. 4 is a larger scale view of the area Mb enclosed in dotted lines in FIG. 4.
Figure 6:
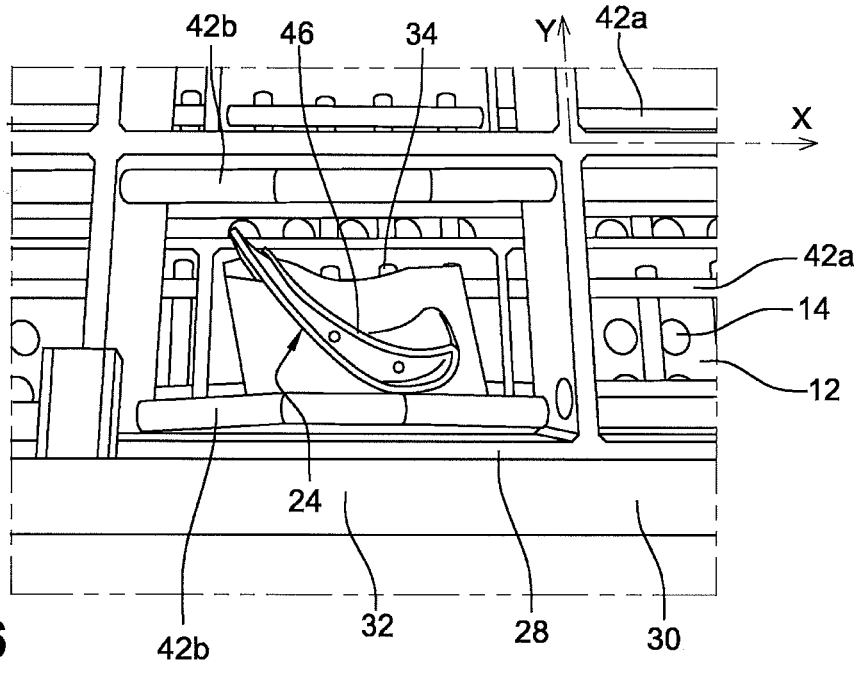
FIG. 6 is a schematic view of a housing of the frame according to the invention, wherein one vane is arranged in the housing.
Figure 7:
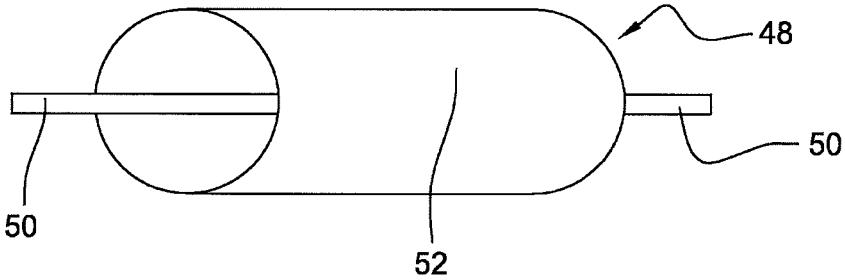
FIG. 7 is a schematic illustration of a rod according to the invention.

(extending along the axis X and perpendicularly to the bottom wall 12 and of first transverse partitions 16*b* extending along the axis Y and perpendicularly to the bottom wall 12 (FIGS. 2, 3 and 4). The first longitudinal partitions 16*a* and transverse partitions 16*b* are flat and intersect each other. The first grid 16 is connected, via arms 18 extending along the axis Z to a second grid 20 formed of second flat longitudinal partitions 20*a* and transverse partitions 20*b*. As can be seen in FIG. 2, the first grid 16 and the second grid 20 jointly define housings 22, each capable of receiving a vane 24 (FIG. 6). Each vane 24 is inserted by means of its foot 26 in a housing 22. Such a frame 10 allows handling of a plurality of vanes 24 and in particular, feeding these vanes 24 into a heat treatment furnace. The first grid 16 and second grid 20 each comprise an internal peripheral wall 28 and an external peripheral wall 30 defining a groove 32 between them on each side of the frame 10.

According to the invention, the first longitudinal partitions 16*a* and transverse partitions 16*b* in addition to the second longitudinal partitions 20*a* and transverse partitions 20*b* are crossed by rods for supporting and holding the vanes away from the bottom wall 12 as well as from said longitudinal partitions 16*a*, 20*a* and transverse partitions 16*b*, 20*b*.

As shown in FIGS. 3 and 4, each housing 22 is crossed by a first, a second and a third group of rods, with the rods of each group being substantially parallel to each other.

The first group of rods comprises two rods 34 substantially parallel to the bottom wall 12 and extending in the transverse direction (axis Y). These rods 34 of the first group cross the first longitudinal partitions 16*a* and are arranged symmetrically in relation to each other with respect to a median plan YZ of the housing 22. The rods 34 of the first group cross the first longitudinal partitions 16*a* at notches 36 of said longitudinal partitions, with the notches 36 emerging on the bottom wall 12 (FIG. 4). The second group of rods comprises two rods 38 parallel to the bottom wall 12 and extending in the transverse direction (axis Y) as well as on either side of the rods 34 of the first group. The rods 38 of the second group cross the first longitudinal partitions 16*a* at orifices 40 with a section corresponding to that of the rods, circular in this case and these orifices 40 are formed away from the bottom wall 12. The rods 42 of the third group are oriented parallel to the first and second longitudinal partitions 16*a*, 20*a* and cross the first and second transverse partitions 16*b*, 20*b*. This third group comprises four rods 42, two first rods 42*a* of which cross the first transverse partitions 16*a* and two second rods 42*b* of which cross the second transverse partitions 20*b*. The first rods 42*a* of the third group are arranged symmetrically in relation to each other with respect to a plane XZ median to the housing, whereas the second rods 42*b* of the third group are offset in relation to each other with respect to the axis Z. The first rods 42*a* and the second rods 42*b* of the third group cross the first and second transverse partitions 16*a*, 20*b* at orifices with a circular section 44 formed in these partitions (FIG. 4). It should be noted that the orifices for passage of the first rods 42*a* of the third group are positioned along the axis Z between the orifices for passage 40 of the rods 38 of the second group in the first longitudinal partitions 16*a* and the orifices for passage 44 of the second rods 42*b* of the third group in the second transverse partitions 20*b*.

Figure 5:
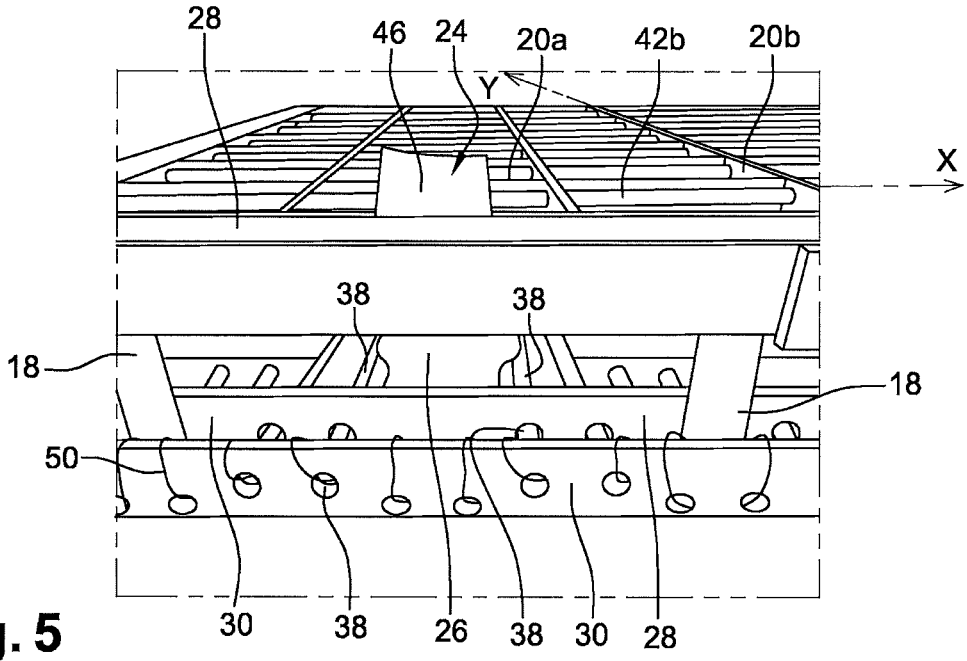
FIG. 5 is a larger scale view of a side of the frame according to the invention.

Each vane 24 is arranged in a housing 22 so as to be supported by the rods 34 of the first group, thereby avoiding contact with the metal bottom wall 12. The rods 38 of the second group provide for holding the vane in the axis X, avoiding movements of the vane foot 26 along this axis. The rods 42*a*, 42*b* of the third group provide for holding the vane in the axis Y. More specifically, the first rods 42*a* of the third group provide for holding the vane foot 26 in the axis X and the second rods 42*b* of the third group provide for holding the blade 46 of the vane in the axis X (FIGS. 5 and 6). It should be noted that the risks of the blade 46 of the vane 24 tilting along the axis Y are very limited owing to the elongated shape of the vane foot 26 along the axis X, which explains the absence of pins for holding the blade 46 of the vane 24 in the axis Y. It would however obviously be possible to incorporate, if necessary, a fourth group of rods crossing the second longitudinal partitions.

According to the invention, each rod 48 is formed of a rigid metal wire 50 around which tubes made of ceramic material 52 are engaged. The rods thus formed are engaged in the orifices of the first and second longitudinal partitions 16*a*, 20*a* and transverse partitions 16*b*, 20*b*. The ends of the wires 50 are fixed to the internal peripheral walls 16, 20 or external peripheral walls 28, 30 of the first and second grids (FIGS. 1 and 5).

Use of rods 48 comprising a metal wire 50 and a plurality of tubes 52 made of thermally-insulating material, such as ceramic, makes it easily possible to avoid contacts between the vanes 24 and the frame 10, while avoiding the problems of the prior art. The ceramic of the tubes is not deposited on the vanes during the various treatments of the vanes, since the ceramic of the tubes is not deposited in a fine layer on a support from which it could become detached. On the contrary, the ceramic tubes are made from solid material and are independent from the support.

The metal wire 50 is preferably a material capable of resisting temperatures of up to 1300° C. and able to withstand 350° C./minute under argon pressure at 5 bars absolute. Such a material is for example a stainless steel.

The invention claimed is:

1. A frame for handling vanes, comprising a bottom wall bearing a plurality of longitudinal partitions and transverse partitions forming a grid defining a plurality of housings, each housing capable of receiving a vane, wherein each housing comprises rods for supporting and holding the vanes away from the bottom wall and away from the plurality of longitudinal partitions and transverse partitions, wherein said rods cross the plurality of longitudinal partitions and transverse partitions and extend into the housings and are produced, at least externally, from a thermally insulating material.

2. The frame according to claim 1, wherein the rods extend substantially parallel to at least one of the longitudinal partitions and the transverse partitions.

3. The frame according to claim 1, wherein each housing is crossed by three groups of rods, each group of rods formed of at least two rods substantially parallel to each other, wherein the at least two rods of a first group support and hold the vanes away from the bottom wall, wherein the at least two rods of a second group hold the vanes away from the longitudinal partitions, and wherein the at least two rods of a third group hold the vanes away from the transverse partitions.

4. The frame according to claim 1, wherein each rod is formed of a rigid metal wire around which tubes made of ceramic material are engaged.

5. The frame according to claim 1, wherein the bottom wall comprises orifices and is in contact with a first grid formed of first longitudinal partitions and first transverse partitions, wherein the first grid is connected by aims perpendicular to the bottom wall to a second grid formed of second longitudinal partitions and second transverse partitions.

6. The frame according to claim 1, wherein the thermally-insulating material is a ceramic material.

7. A method for heat treatment of a vane, comprising:

a) providing a frame according to claim 1, b) inserting the vanes into at least some of the housings in the frame such that the vanes come into contact with the rods, c) inserting the frame bearing the vanes into a furnace for heat treatment of the vanes.

* * * * *